United States Patent [19]

Ho

[11] 4,296,532

[45] Oct. 27, 1981

[54] CLASP FOR WATCH STRAP

[75] Inventor: Kok-Kit Ho, Kam Tin, N.T., Hong Kong

[73] Assignee: Timex Corporation, Waterbury, Conn.

[21] Appl. No.: 132,486

[22] Filed: Mar. 21, 1980

[51] Int. Cl.[3] ..... A44B 21/00

[52] U.S. Cl. ..... 24/206 R; 24/265 WS

[58] Field of Search ..... 24/206 R, 240, 241, 24/236, 265 WS, 265 R

[56] References Cited

U.S. PATENT DOCUMENTS

| | | | |
|---|---|---|---|
| 1,647,108 | 10/1927 | Hadley | 24/206 R X |
| 2,474,372 | 6/1949 | Schmith | 24/206 R |
| 3,574,903 | 4/1971 | Namiki | 24/265 WS |
| 3,992,757 | 11/1976 | Danna | 24/206 R X |
| 4,096,688 | 6/1978 | Rieth | 24/206 R |
| 4,133,082 | 1/1979 | Kanzaka | 24/206 R |

FOREIGN PATENT DOCUMENTS

| | | | |
|---|---|---|---|
| 1234440 | 2/1967 | Fed. Rep. of Germany | 24/206 R |
| 465942 | 1/1969 | Switzerland | 24/265 WS |

*Primary Examiner*—Roy D. Frazier
*Assistant Examiner*—Peter A. Aschenbrenner

[57] ABSTRACT

A clasp construction is provided for releasably connecting the ends of a wrist watch strap together. The clasp comprises a U-shaped frame, a spring plate supported in the frame to define a passage into which one strap end is inserted and clamped by action of the spring plate thereagainst and a clasp cover having the other strap end affixed thereto, the cover being releasably attached to the spring plate by combined hooking and snap-fitting engagement. The strap length need be adjusted only once by clamping the one strap end at a desired position within the frame. Thereafter, the strap can be removed from the wearer's wrist simply by releasing the clasp cover from the spring plate without disturbing the adjusted strap length.

5 Claims, 6 Drawing Figures

CLASP FOR WATCH STRAP

FIELD OF THE INVENTION

The present invention relates to an improved clasp construction for releasably connecting the ends of a bracelet, especially a wrist watch strap or band, together.

DESCRIPTION OF PRIOR ART

A particular clasp commonly available for a wrist-watch strap employs a generally U-shaped sheet metal frame defining a channel along the length of the strap for receiving one end thereof. A clamping plate typically is positioned atop the strap end inside the channel, oftentimes being pivotably supported in the frame by means of projecting ears on opposite sides passing through suitably disposed openings in the sheet metal frame. A clamping lever which also functions in most cases as the clasp cover or cap is also pivotably supported at one end in the frame and includes cam means typically in the form of a projecting nose or the like to press down on the clamping plate when the cover is closed to bind the strap end in the channel against the bottom of the sheet metal frame thus securing that end of the strap. The other end of the strap is usually permanently affixed to the sheet metal frame directly or through two or more foldable, extension plates. Illustrative of this type of clasp construction are the Williams U.S. Pat. No. 3,319,308 issued May 16, 1967; Campaiola U.S. Pat. No. 3,339,248 issued Sept. 5, 1967; Iirzuka U.S. Pat. No. 3,636,596 issued Jan. 25, 1972 and Mochizuki U.S. Pat. No. 3,797,716 issued Mar. 19, 1974.

A clasp construction in which one of the strap ends is clamped in a housing in the manner described above but in which the other end of the strap is releasably hooked onto lugs of a sheet metal housing is shown in the Danna U.S. Pat. No. 3,992,757 issued Nov. 23, 1976. This clasp construction includes a hinged cover along one side of the housing which cover is closed over the hooked strap end and snap-fitted onto the housing to prevent accidental disengagement of the hooked end.

Still other types of clasp constructions for use with wrist watch straps are disclosed in the Namiki U.S. Pat. No. 3,574,903 issued Apr. 13, 1971, and the Rieth U.S. Pat. No. 4,023,240 issued May 17, 1977.

SUMMARY OF THE INVENTION

The present invention provides an improved clasp construction particularly useful for releasably connecting the free ends of a wrist watch or other type strap together.

It is an object of the invention to provide an improved clasp construction in which one strap end is securely clamped in a frame but can be adjusted therein to vary the length of the strap to suit the wrist of the wearer.

It is another object of the invention to provide a clasp construction in which the other strap end is affixed to the clasp cover which, in turn, is releasably engaged to the frame by combined hooking and snap-fitting action.

The improved clasp construction is advantageous since adjustment of the strap length is effected simply by pulling the one strap end into or out of the frame and then clamping it in the desired position against further movement and since the wearer can thereafter remove the strap without altering the adjusted length simply by releasing the clasp cover from the frame.

Typically, the improved clasp includes a U-shaped sheet metal frame defining a channel elongated in the direction of the strap length, the frame having a base plate with upright side walls forming the channel. An elongated spring plate is mounted between the side walls along the length of the frame above the base plate to provide a passage into which one of the strap ends is inserted to the degree necessary for proper adjustment of the strap length. An important feature of the invention is that the spacing between the spring plate and base plate is preselected so that the strap is clamped therebetween by action of the spring plate thereagainst regardless of whether the clasp cover is attached. Typically, the transverse ends (leading and trailing ends) of the spring plate are mounted on projections extending from the facing side walls of the frame and to this end the transverse ends of the spring plate preferably include loops or bends wrapping at least partially around such side wall support projections. Another important feature of the clasp of the invention is that the leading transverse end of the spring plate is configured to provide a hook-engaging surface while the trailing transverse end is shaped to provide a cam-engaging surface for effecting releasable engagement with the clasp cover. Still another important feature is that the clasp cover includes a hook at its leading edge adapted to interlock with the hook-engaging surface on the corresponding end of the spring plate and is permanently affixed at its trailing edge to the other strap end, with either the trailing end of the clasp cover or other strap end attached thereto providing a cam surface to snap-fit against the cam-engaging surface at the trailing end of the spring plate. The clasp cover also preferably includes depending longitudinal side-walls adapted to abut against the spring plate when the clasp cover is closed releasably onto the spring plate to enhance the clamping action of the spring plate against the end of the strap secured therebeneath. Clamping action on the strap end can be further enhanced by providing the base plate of the frame with one or more upward transverse projections to seat into suitable transverse recesses provided in the bottom of the strap end. In this construction, it is preferred to provide one or more access openings in the base plate so that the wearer can push the strap end out of engagement with the base plate projection against the bias of the spring plate and slide the strap end into or out of the channel for adjustment of strap length.

DESCRIPTION OF PREFERRED EMBODIMENTS

Figure 1:
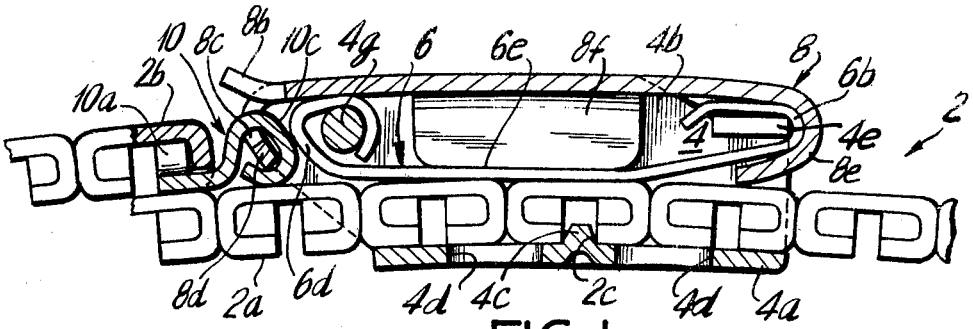
FIG. 1 is a side elevation of the clasp of the invention with the nearest side wall of the clasp frame removed.
Figure 2:
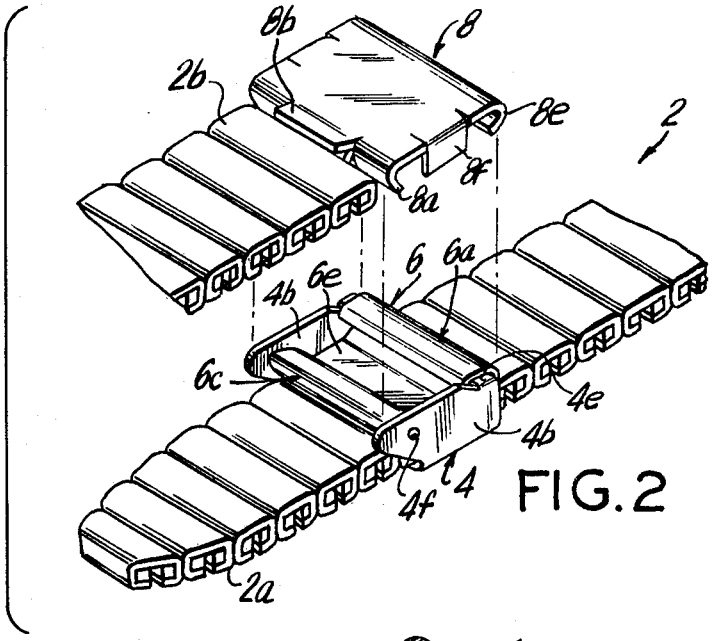
FIG. 2 is a perspective view of the clasp of the invention in the disconnected state.

Referring to FIGS. 1 and 2, a preferred clasp of the invention is shown with a link watch 2 having ends 2*a* and 2*b*. Of course, the other ends of the strap are attached to the spaced lugs of a watch case in conventional fashion. The clasp is shown as comprising three primary components, namely, sheet metal frame 4 spring plate 6 and clasp cover 8.

Figure 3:
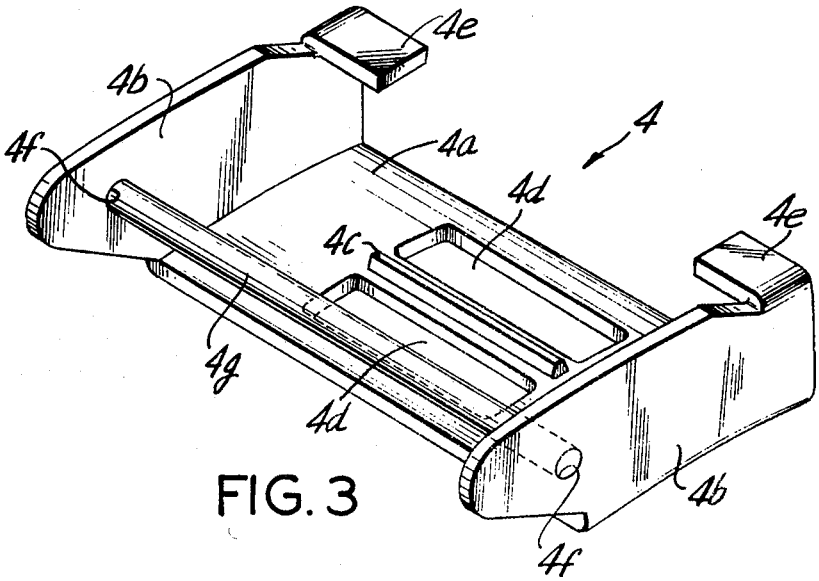
FIG. 3 is a perspective view of the clasp frame.
Figure 4:
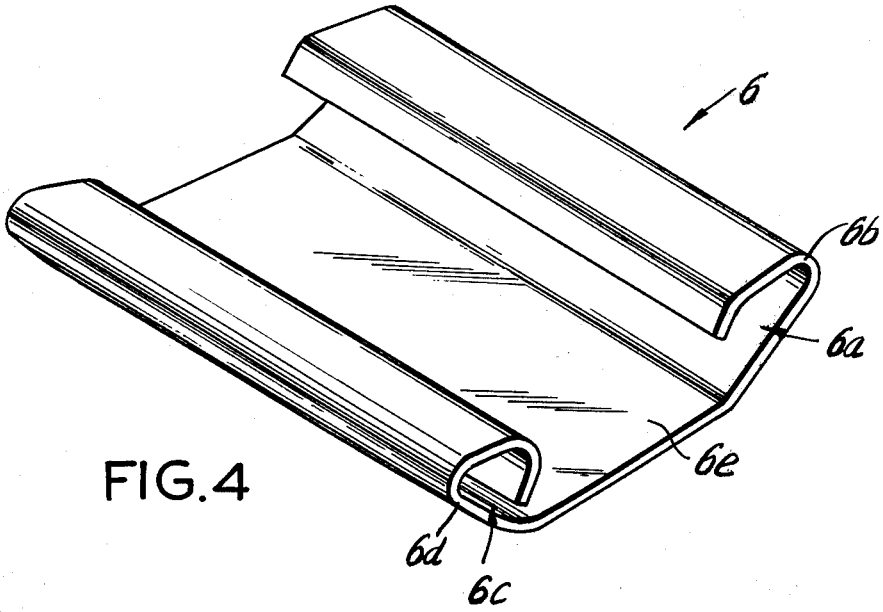
FIG. 4 is a perspective view of the spring plate.

The U-shaped frame 4 is shown in more detail in FIG. 3 and includes base plate 4*a* and spaced upright longitudinal side walls 4*b* which together form a channel for receiving strap end 2*a* as shown in FIG. 1. The base plate 4*a* preferably includes a transversely oriented rib 4*c* projecting upwardly therefrom and access openings 4*d* for purposes to be described hereafter. Each side wall includes an inwardly bent tab 4*e* at the leading edge of the frame and circular openings 4*f* near the trailing edge. Support bar 4*g* is inserted between the side walls 4*b* with its ends secured in side wall openings 4*f*. The U-shaped clasp frame 4 typically is made of sheet metal suitably bent and blanked with support bar 4*g* provided as a separate component and inserted in a separate assembly step.

Spring plate 6 is mounted between the sidewalls 4*b* at its leading end by inwardly bent support tabs 4*e* and at its trailing end by support bar 4*g*, as shown most clearly in FIG. 1. As shown, the spring plate 6 includes a transversely oriented, somewhat flat loop 6*a* at its leading end into the sides of which support tabs 4*e* are inserted. The loop 6*a* includes a sharp bend at the leading end to form a hook-engaging surface 6*b*. At the trailing end, the spring plate includes a more rounded, transversely oriented loop 6*c* through which support bar 4*g* passes. Loop 6*c* has a flat cam-engaging surface 6*d* at the trailing edge. As shown, the spring plate 6 is supported in the clasp frame 4 such that a passage is defined between the spring and base plate to snuggly receive strap end 2*a*. Spring plate 6 includes a generally flat pressure surface 6*e* intermediate the leading and trailing ends. The spring plate 6 is bent or configured with such a profile that pressure surface 6*e* bears downwardly against strap end 2*a* therebeneath to bind it against base plate 4*a* and prevent movement thereof. Importantly, this binding action is supplied by the spring plate regardless of whether the clasp cover 8 is engaged. Preferably, strap end 2*a* includes spaced transverse recesses 2*c* in the lower surface facing the base plate into one of which recesses the projecting rib 4*c* can seat to further secure the strap end against movement in the frame, once proper length adjustment of the strap is made.

Figure 5:
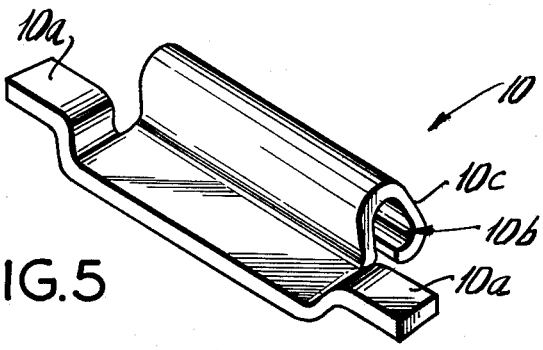
FIG. 5 is a perspective view of the connector bar connecting the clasp cover and strap end together.
Figure 6:
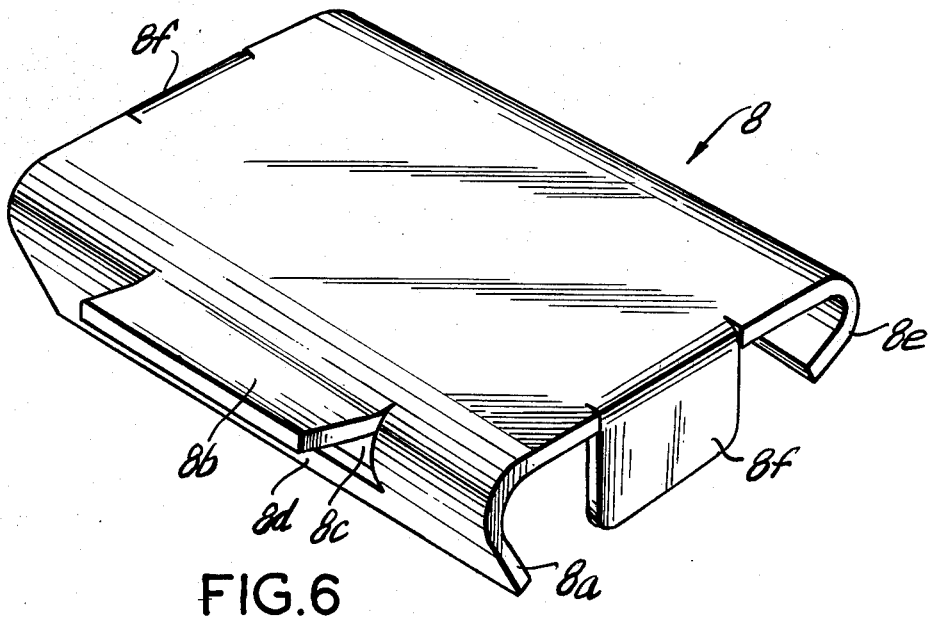
FIG. 6 is a perspective view of the clasp cover.

As shown in FIG. 1, clasp cover 8 is secured to strap end 2*b* by means of connector pin 10. The connector pin includes outwardly projecting ears 10*a* on opposite sides engaged to strap end 2*b* and a transverse loop 10*b* having a flat cam surface 10*c* at the leading end thereof, FIG. 5. The trailing end of the clasp cover 8 includes a depending wall 8*a* from which a finger tab 8*b* is bent upwardly forming a transverse slot 8*c* and flange 8*d* in the wall, FIG. 6. The loop 10*b* of the connector pin is formed and bent around flange 8*d* as shown in FIG. 1 so that cam surface 10*c* will come into snap-fit relation with cam-engaging surface 6*d* of spring plate 6 when the clasp cover 8 is releasably secured to the spring plate by engaging hook 8*e* of the cover around hook-engaging surface 6*b* and then pressing the clasp cover downwardly near the trailing end. Preferably, the clasp cover includes depending, longitudinal side walls 8*f* which are adapted to contact the spring plate 6 above the pressure surface 6*e* to enhance clamping of strap end 2*a* therebelow. Hook 8*e* of the clasp cover may also press against the strap end 2*a* for the same purpose, as shown in FIG. 1. Clasp cover 8 is also formed of sheet metal suitably bent, blanked and pierced.

Of course, those skilled in the art will realize that connector pin 10 forming the end of the strap is not essential since strap end 2*b* and depending wall 8*a* of the clasp cover could be joined directly together, e.g. by brazing or providing suitable connector means on either the strap end or depending wall, in which case a cam surface corresponding to surface 10*c* could be provided on the strap end 2*b* or depending clasp cover wall 8*a*.

The clasp of the invention is advantageous since adjustment in strap length to suit a particular wearer is made only once. It is further advantageous since removal by the wearer is accomplished simply by releasing the clasp cover 8 from the spring plate 6. It is still further advantageous in the event that the cam and cam-engaging surfaces 10*c* and 6*d* become accidentally disengaged, since hook 8*e* and hook-engaging surfaces 6*b* could still remain interlocked to hold the strap ends together. Adjustment of the length of the strap is easily accomplished by the wearer by pushing the bottom of strap 2*a* away from base plate 4*a* against the bias of spring plate 6 to release the projecting rib 4*c* from the recess in the strap bottom and then sliding strap end 2*a* to the desired position. A pencil or other simple tool inserted through access openings 4*d* in the base plate 4*a* is effective to release the strap end from the projecting rib against the spring plate bias. When the desired strap length is achieved the strap end 2*a* is simply released and the bias of the spring plate forces it against base plate 4*a*, preferably with rib 4*c* seated in one of the strap recesses 2*c*. Thereafter, no further adjustment of strap length is required since the wearer removes the strap simply by releasing the clasp cover 8 from engagement with spring plate 6. In fastening the clasp, hook 8*e* of the clasp cover is first engaged around hook-engaging surface 6*b* and then the clasp cover is pressed down near the trailing end to bring cam and cam-engaging surface 10*c* and 6*d* into locked, snap-fitted relation.

It should be apparent to those skilled in the art that various changes in the form and detail of the invention can be made and it is intended that such changes be included within the claims appended hereto. As used herein, watch strap is intended to include but not be limited to synthetic or leather straps, bands of the expansible or nonexpansible type as well as other bracelet constructions.

We claim:

1. A clasp construction for releasably connecting the ends of a bracelet together, comprising:

(a) an elongated U-shaped frame having a base plate and spaced upright walls along the sides thereof;

(b) a resilient spring plate mounted between the sidewalls of the frame in spaced relation above the base plate to define a longitudinal passage therebetween for receiving one end of the bracelet and shaped to clamp the bracelet end against the base plate at a selected position, said spring plate having a transversely-oriented hook-engaging surface at one end and a transversely-oriented cam engaging surface at the other end with a pressure surface therebetween to bear against said bracelet end for effecting said clamping action, said bracelet end being adjustable in position along the passage by sliding while the spring plate bias is temporarily released; and (c) a cover member attached permanently at one end to the other bracelet end with at least one of said other bracelet end and said cover member end having a cam surface adapted to engage in snap-fit relation against the cam-engaging surface of said spring plate, said cover member having at the other end a hook surface adapted to engage around the hook-engaging surface of said spring plate, whereby said cover member is releasably attached to said spring plate by first engaging the hook and hook-engaging surfaces and then pressing down on the cover member to snap-fit the cam and cam-engaging surfaces together.

2. The clasp construction of claim 1 wherein the cover member includes spaced depending sidewalls intermediate the ends of the cover member, said depending sidewalls contacting the spring plate above the pressure surface to enhance clamping of said one bracelet end therebelow.

3. The clasp construction of claim 1 wherein the base plate of the frame includes a transverse, upwardly projecting rib to seat in a transverse recess in said one bracelet end to prevent movement thereof.

4. The clasp construction of claim 1 wherein the base plate of the frame includes in access opening through which said one bracelet end can be pressed to temporarily release the spring plate bias thereagainst, permitting sliding of said end for length adjustment purposes.

5. The clasp construction of claim 1 wherein a connector pin is attached to said other bracelet end and is attached to the cover member, said connector pin having said cam surface.

* * * * *